US006666061B2

(12) United States Patent
Heimann

(10) Patent No.: US 6,666,061 B2
(45) Date of Patent: Dec. 23, 2003

(54) APPARATUS FOR DEEP ROLLING OF RECESSES AND RADII OF CRANKSHAFT JOURNAL BEARINGS

(75) Inventor: Alfred Heimann, Aachen (DE)

(73) Assignee: Hegenscheidt-MFD GmbH & Co. KG, Erkelenz (DE)

( * ) Notice: Subject to any disclaimer, the term of this patent is extended or adjusted under 35 U.S.C. 154(b) by 0 days.

(21) Appl. No.: 10/156,676

(22) Filed: May 28, 2002

(65) Prior Publication Data

US 2002/0189312 A1 Dec. 19, 2002

(30) Foreign Application Priority Data

May 28, 2001 (DE) ..... 101 26 064

(51) Int. Cl.[7] ..... B21D 15/00

(52) U.S. Cl. ..... 72/110; 72/8.3; 72/10.1; 72/31.07

(58) Field of Search ..... 72/7.4, 8.3, 11.1, 72/31.03, 31.07, 107, 110, 10.1, 10.7; 29/6.01, 888.08

(56) References Cited

U.S. PATENT DOCUMENTS

| | | | | | |
|---|---|---|---|---|---|
| 3,948,076 | A | * | 4/1976 | Eitel et al. | 72/384 |
| 4,682,489 | A | * | 7/1987 | Bauerle et al. | 72/460 |
| 4,870,845 | A | | 10/1989 | Nakagawa | |
| 5,138,859 | A | * | 8/1992 | Winkens | 72/110 |
| 5,333,480 | A | | 8/1994 | Berstein | |
| 5,445,003 | A | | 8/1995 | Gottschalk et al. | |
| 5,495,738 | A | | 3/1996 | Gottschalk | |
| 5,666,841 | A | * | 9/1997 | Seeger et al. | 72/110 |
| 6,393,885 | B1 | * | 5/2002 | Cadena | 72/110 |

FOREIGN PATENT DOCUMENTS

| | | | | |
|---|---|---|---|---|
| DE | 3625961 | * | 3/1987 | 72/11.1 |
| DE | 19511882 A1 | | 10/1996 | |
| EP | 0299111 B1 | | 6/1994 | |
| EP | 0661137 B1 | | 1/1995 | |
| EP | 0683012 A1 | | 1/1995 | |
| JP | 06143129 | | 5/1994 | |
| JP | 11-333520 | * | 7/1999 | 72/110 |

OTHER PUBLICATIONS

Berstein G., Felgentreu G., Hegenscheidt GMBH. "Aspekte Der Qualitatssicherung Beim Festwalzen" DGM–Informationsgesellschaft, 1989, Seiten 231–239, XP001113192.
European Search Report 02011109.2–2302; Oct. 7, 2002.

* cited by examiner

*Primary Examiner*—Ed Tolan
(74) *Attorney, Agent, or Firm*—Carlson, Gaskey & Olds

(57) ABSTRACT

An apparatus (5) for the deep rolling of recesses (4) and radii of crankshafts (1). The deep rolling is accomplished with the aid of deep-rolling rollers (8) which, during revolution of the crankshaft (1), penetrate into the recesses (4) or radii of the crankshaft (1) under application of a deep-rolling force and at an angle of approximately 35° and bring about a deformation in the crankshaft (1) itself. According to the invention, the depth of penetration of the deep-rolling rollers (8) in the crankshaft (1) is measured in the radial direction and the magnitude of the deep-rolling force is regulated as a function of the measured penetration depth in such a fashion that in the course of at least one revolution of the crankshaft (1) a plastic deformation corresponding to a predefined rolling depth is obtained at least at one of the two recesses (4) or radii of a relevant journal bearing (2) after the deep rolling.

17 Claims, 7 Drawing Sheets

APPARATUS FOR DEEP ROLLING OF RECESSES AND RADII OF CRANKSHAFT JOURNAL BEARINGS

RELATED APPLICATIONS

This invention claims priority to German Application No. 10126064.4, filed May 28, 2001.

BACKGROUND OF THE INVENTION

The invention relates to a method and apparatus for deep rolling recesses and radii on crankshafts according to the features of the preamble of the main claim.

The deep rolling of crankshafts is accomplished by means of deep-rolling rollers which are pressed with a predefined force into the recesses and radii which respectively laterally delimit the bearings of a crankshaft. A method, a machine or tools for deep rolling the radii and recesses of crankshafts are disclosed, for example, in EP 0 683 012 A1 and also in EP 0 661 137 B1 and EP 0 299 111 B1. In the known methods using the known machines the crankshaft material is plasticized to a depth of approximately 1 mm with the aid of deep-rolling rollers which are rotatably supported in the deep-rolling tool. In this case, residual compressive stresses build up tangentially around the rolling radius of the deep-rolling rollers, which reduce the formation of cracks at the critical points of the transition of the bearing pin to the cheek of the crankshaft during operation of the crankshaft under bending stress and thus appreciably enhance the fatigue strength of a crankshaft. The quality of any deep rolling is of decisive importance for the service life of a crankshaft. With higher torques and higher engine performance, especially with the widespread use of diesel engines, the requirements for crankshafts are becoming increasingly demanding. In consequence, the industry has moved towards making the deep rolling of crankshafts increasingly critical and with increasingly higher precision. So far it is known that deep rolling force can be carried out with a predefined deep rolling force. However, adhering to the deep-rolling force alone is not able to compensate for the spreads in the strength of the crankshaft material or the inaccuracies introduced into the crankshaft during the pre-processing of the crankshaft, especially during cutting and, if appropriate, hardening. Errors in the pre-processing at recesses or radii on a crankshaft to be deep-rolled are not detected by the known methods where a pre-defined deep-rolling force is adhered to.

A method for strengthening workpiece surfaces has also been disclosed in DE 195 11 882 A1. The known method can be applied to crankshaft processing. In this case, the workpiece surface is measured during the strengthening process and controlled variables for setting/changing tool parameters are derived from the measured results. The depth of penetration of the deforming tool into the workpiece surface is especially determined. A deep-rolling roller applying a corresponding pressing force penetrates into the material and thus produces ridges on both sides of the penetrating deep-rolling roller depending on the flow behavior of the work piece material. The actual penetration depth of the deep-rolling roller is then obtained from the difference in the ridges. The surface contour can then be measured in various different ways, for example, mechanically, pneumatically, hydraulically, acoustically, electromagnetically, electrocapacitatively or electronically using suitably acting sensors.

A disadvantage of the known method is the indirect recording of the penetration depth via the ridges on both sides of the penetrating deep-rolling roller. Such ridges are sometimes not present at all or are so little defined that they can barely be measured. This is especially the case, for example, with the ridges at the transitions to both sides of recesses on crankshafts which lie in respectively different planes. Experience has shown that the accuracy with which the ridges can be measured is not sufficient to make reliable statements on the depth of penetration of the deep-rolling roller into the crankshaft. Instead of this, it is substantially more favorable to directly follow the path of the deep-rolling roller, whether in the radial direction or in the axial direction of movement relative to the crankshaft, or in both directions of movement at the same time.

In industrial practice, the situation may also arise where individual deep-rolling rollers of a machine have a shorter service life compared with the other deep-rolling rollers and prematurely fail. With the means known so far, it is difficult or completely impossible to detect such premature failure of the deep-rolling tool. The industry has thus managed so far by randomly checking the rolled radii or recesses of crankshafts using clip-on instruments which are applied manually.

From the difficulties and disadvantages described previously, the object for the invention is to further improve the deep rolling of radii and recesses of crankshafts in order to achieve in particular a uniform product result and to detect in good time and eliminate any errors which have crept into the process from the preceding processing of the workpiece. In this way, the improvement should be attainable without additional expenditure and in an economical fashion. In particular, already existing equipment such as crankshaft deep-rolling machines and crankshaft deep-rolling tools as well as inherently known measuring and regulating equipment should be used to implement and the deep rolling without any substantial changes.

SUMMARY OF THE INVENTION AND ADVANTAGES

The present invention proposes an apparatus and method with which the penetration depth is measured continuously in the radial direction of the deep-rolling rollers of a deep-rolling tool and the magnitude of the deep-rolling force is regulated as a function of the measured penetration depth such that in the course of the deep-rolling operation at the recesses or radii of a journal bearing after deep rolling there is maintained a plastic deformation which corresponds to a pre-defined rolling depth.

In a similar fashion, errors which have been introduced into the crankshaft during the pre-processing, whether as a result of cutting or as a result of hardening, are detected. For this purpose there is used a measuring tool which has a structure identical to a deep-rolling tool. Before the actual beginning of the deep-rolling operation measuring rollers are inserted into the recesses of the journal bearings under a low applied force. The axial spreading of the measuring rollers which takes place during the penetration is recorded and determined as the measured value for the quality of the pre-processing. Sensors which record the axial distance between individual measuring rollers and the adjacent oil collars of the crankshaft are used for this purpose.

The known method of deep rolling the recesses and radii of crankshafts with a pre-defined rolling depth is now improved by achieving a specific rolling depth depending on the particular state of the radii or recesses of the crankshaft to be deep-rolled and suitably varying the deep-rolling force to achieve this rolling depth.

The apparatus can implement such a method using a single deep-rolling roller of a deep-rolling tool but the resulting penetration depth of both deep-rolling rollers usually used on a deep-rolling tool can also be measured. In addition, the resulting axial displacement of the measuring rollers of a measuring tool can be recorded. Several devices are suitable for measuring the penetration depth of the deep-rolling rollers or the displacement of the measuring rollers of a measuring tool in the axial direction and the particular selection is in each case within the measures of the relevant technical specialist.

The penetration depths of the deep-rolling rollers of a deep-rolling tool or the displacements of the measuring rollers of a measuring tool measured using sensors are fed to a computer, saved in the computer, converted into operands and the deep-rolling force is regulated accordingly. The usual procedure involves first rolling the crankshaft at a low and constant applied force before the actual deep rolling and, after the deep-rolling at the deep-rolling force, evaluating the difference between the measured values, which is obtained from the penetration depths at the applied force and the deep-rolling force and then determining the penetration depth using a correspondingly evaluated operand. Such an operand is advantageously suitable for determining the errors which occur during the pre-processing of the crankshaft, whether as a result of cutting or as a result of hardening or damage to the deep-rolling rollers themselves.

The present invention provides a radial intermediate space between the guide roller for the deep-rolling rollers and the journal bearing of the crankshaft there is provided a sensor which measures the penetration depth of the deep-rolling roller in the recesses and radii of the crankshaft. The sensor is connected to a computer which saves the measured values of the penetration depth and converts them into operands, where the computer is again connected to a plurality of control elements of which at least one controls the revolution of the crankshaft and at least one other controls the loading of the pressure-medium cylinder which the pressure medium as a function of the revolution of the crankshaft and the evaluated computer operands to produce the deep-rolling force.

Sensors can be arranged in various measuring planes along the equipment arms. In addition to the possibility of determining the penetration depth of the deep-rolling rollers into the crankshaft in the radial direction, provided that the two measuring rollers of a measuring tool configured as a deep-rolling tool are inclined at an angle of approximately 35° within the measuring rolling tool, it is also possible to determine the axial spreading of the measuring rollers accompanying the penetration of the measuring rollers with the aid of sensors.

Inductive sensors, triangulation sensors which function optically, digital path-measuring sensors, potentiometers or ultrasound sensors are suitable as sensors. The choice of the most suitable sensor in each case lies with the relevant technical specialist. In this case, it is envisaged that triangulation sensors which operate with laser beams can also be used. Both digital path-measuring sensors and capacitative potentiometers can be constructed as devices which measure by the eddy current method. Preferably, the particular sensors have at least tenfold resolution with a measuring range of approximately 1 mm, where the measured value of the rolling depth lies between 0.1 and 0.9 mm.

BRIEF DESCRIPTION OF THE DRAWINGS

The invention is explained subsequently with reference to several examples of embodiment. The drawings which are respectively highly simplified, not to scale and predominantly schematic, are as follows.

DESCRIPTION OF THE PREFERRED EMBODIMENT

In the Figures those parts which directly relate to the crankshaft are respectively made particularly identifiable by shading. Control systems are shown by broken lines.

Figure 1:
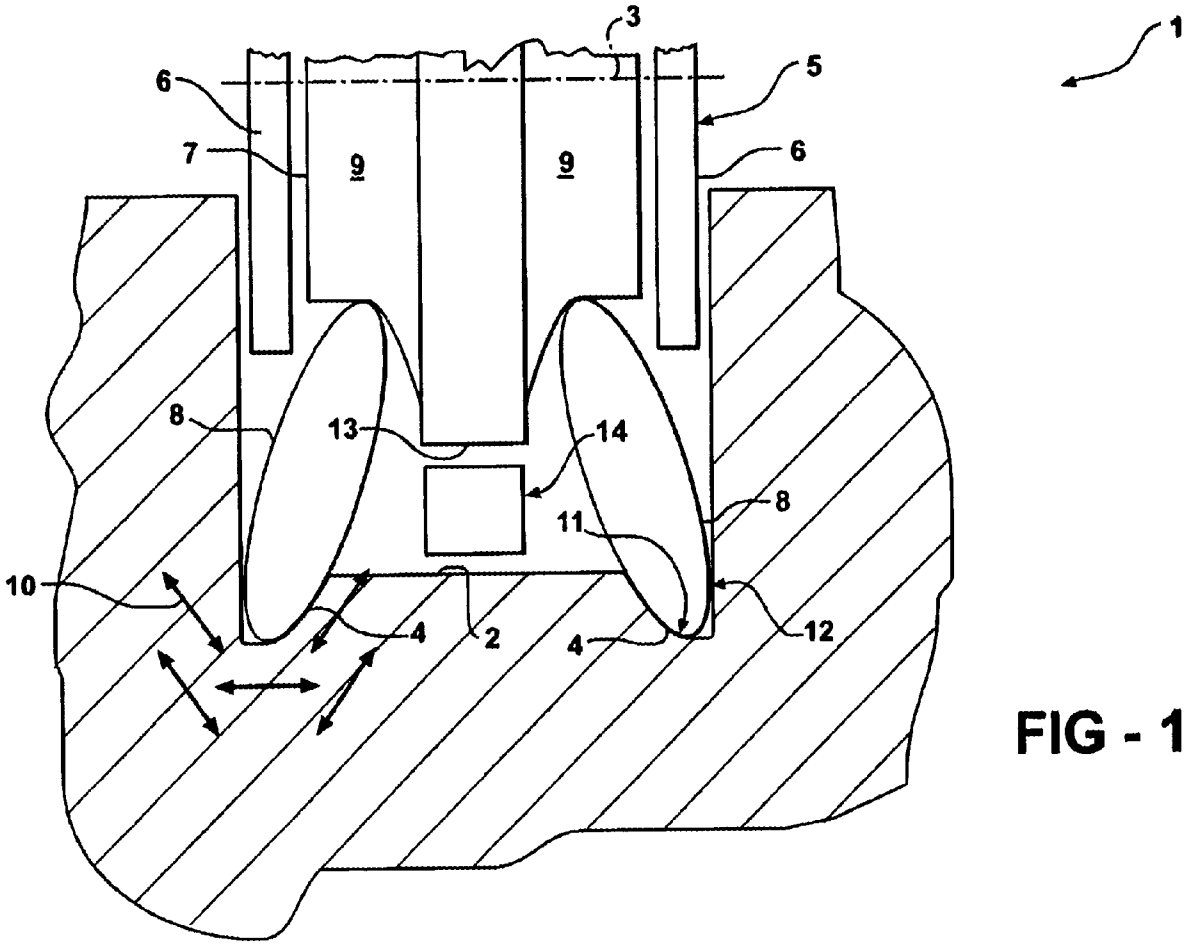
FIG. 1 is a front view of a deep-rolling tool.

FIG. 1 shows the sequence for deep rolling a crankshaft 1. The crankshaft 1 has a journal bearing 2, for example, for a main bearing or a connecting-rod bearing. In the direction of the longitudinal axis of the crankshaft 1, shown, for example, by the dot-dash line 3 running parallel to the longitudinal axis, the journal bearing 2 is delimited on each side by recesses 4. As can be seen clearly in FIG. 1, the two recesses 4 have an axial distance apart which corresponds to the width of the journal bearing 2. According to the selected representation in FIG. 1, the recesses 4 are processed using a deep-rolling tool 5. The deep-rolling tool 5 consists of a tool housing 6 in which a guide roller 7 is supported rotatably about the axis 3. A deep-rolling roller 8 penetrates into each of the recesses 4, wherein the two deep-rolling rollers 8 are spread outwards preferably at an angle of approximately 35° to the vertical and are supported inside the tool housing 6 on guide surfaces 9 of the guide roller 7.

As a result of the action of the deep-rolling rollers 8 on the recess 4, tangential residual compressive stresses shown by the arrows 10 appear inside the crankshaft 1 at the bottom of the recess 4. The bottom of the recesses 4 is indicated by the arrow 11; the arrow 12 indicates the rolling radius which in crankshafts for engines of passenger cars may be between 1.2 and 1.9 mm.

Figure 2:
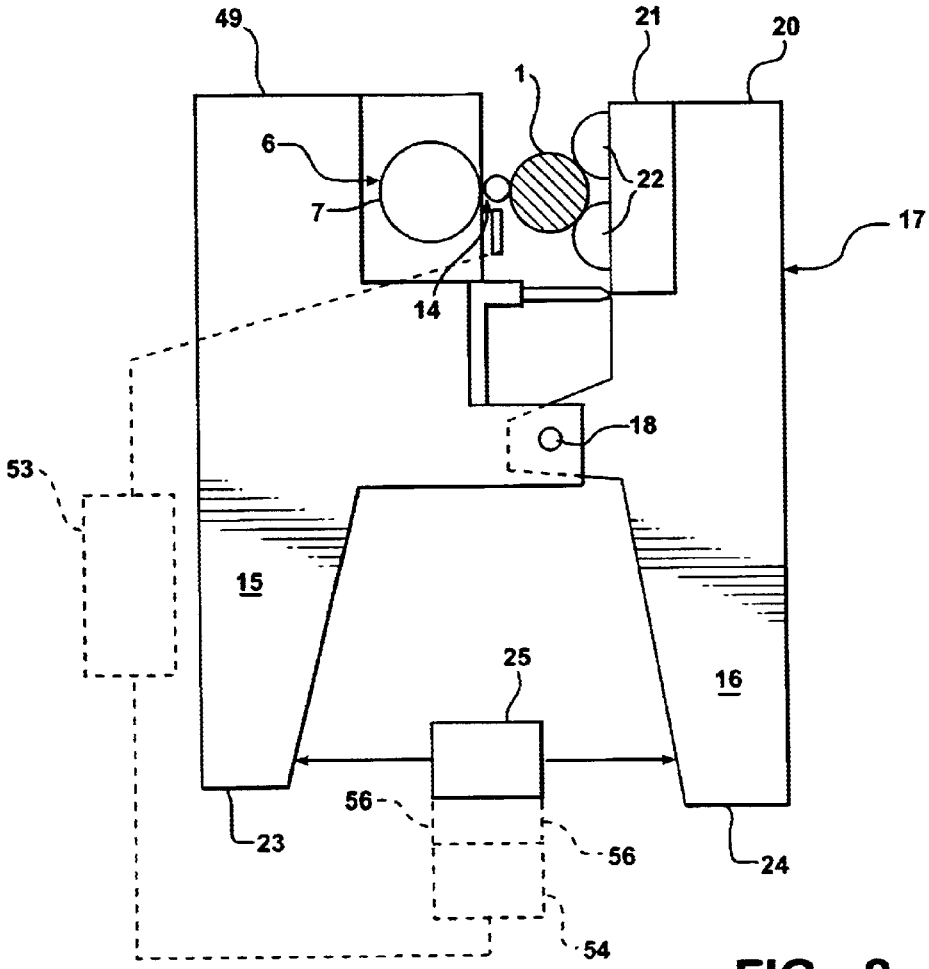
FIG. 2 shows the arrangement of a deep-rolling tool inside a single deep-rolling device.

In the present example, a sensor 14 is located in the radial spacing between the outer circumference 13 of the guide roller 7 and the journal bearing 2 of the crankshaft 1. The sensor 14 is connected to the housing 6 at a suitable point and measures the radial distance between the outer circumference 13 of the guide roller 7 and the journal bearing 2 of the crankshaft 1. The sensor 14 can, for example, be an eddy current sensor in miniature form. The sensor 14 is shown again in FIG. 2. Here, for example, it is located on an equipment arm 15 of a deep-rolling device 17 having the two equipment arms 15 and 16.

As already mentioned, a single deep-rolling machine has a plurality of such deep-rolling devices 17 corresponding to the number of journal bearings 2 to be processed. The two equipment arms 15 and 16 are hinge-connected one to the other at a common pivot point 18 in a scissors fashion. Each of the first outer ends 19 and 20 of the two equipment arms 15 and 16 holds corresponding parts of a deep-rolling tool 5. Thus, for example, at the first outer end 19 of the equipment arm 15 is attached the tool housing 6 with the guide roller 7 and on the opposite first outer end 20 of the second equipment arm 16 is attached a casing 21 with the two supporting rollers 22. The crankshaft 1 is located in between deep-rolling rollers 8 and support rollers 22. According to the representation in FIG. 2, the sensor 14 is attached both to the equipment arm 15 and to the tool housing 6.

Between the two second outer ends 23 and 24 of the equipment arms 15 and 16 there is located a pressure-medium cylinder 25. This pressure-medium cylinder 25 produces the deep-rolling force which is required to deep roll the recesses 4 of the crankshaft 1. The signal from the sensor 14 is transferred, for example, to a computer 53, where it is saved, converted into an operand, and fed to a regulator 54 which regulates the supply of the pressure medium to the pressure-medium cylinder 25. The computer 53 and regulator 54 are equipment familiar to the relevant technical specialist.

Figure 3:
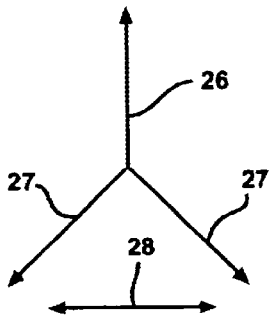
FIG. 3 is a schematic diagram of the measuring directions.

FIG. 3 shows the change in distance 26 of the deep-rolling roller 8 to the bearing surface 2 of the crankshaft 1 in the radial direction. Here only the change in distance 26 of the two deep-rolling rollers 8 is recorded jointly, which each individually undergo a change in their position during the deep-rolling process in the direction of the two arrows 27. It can be seen from FIG. 3 that the two arrows 27 can each be resolved into one component in the vertical direction corresponding to the arrow 26 and one component 28 in the direction of the axis of rotation 3.

Figure 5:
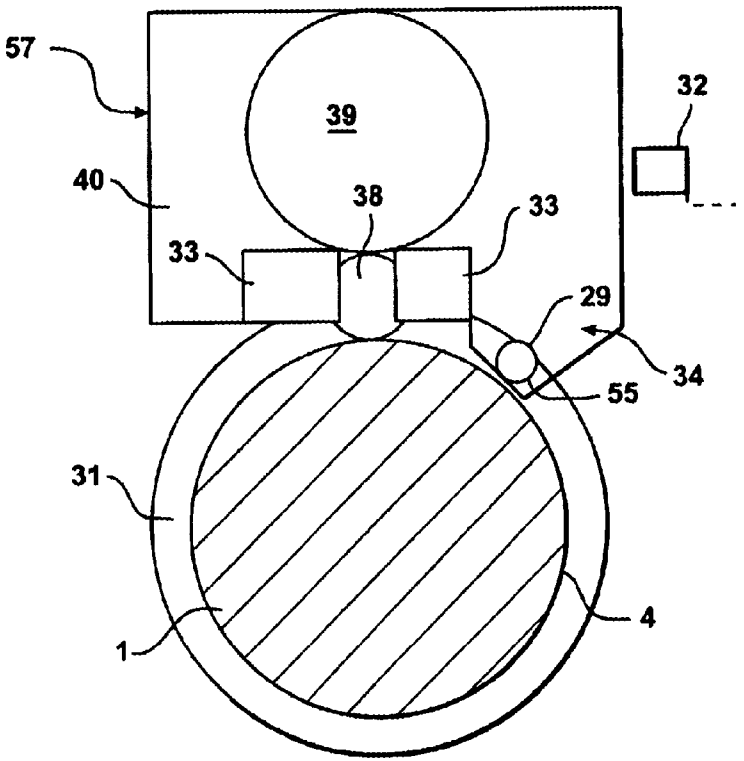
FIG. 5 is a side view of the measuring arrangement in FIG. 2.
Figure 4:
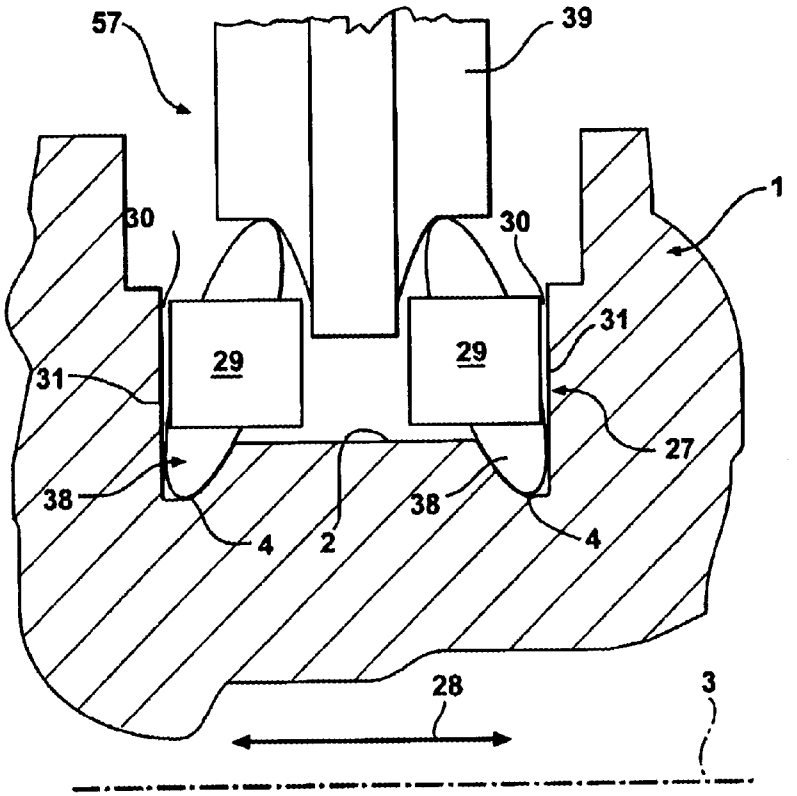
FIG. 4 shows the measurement of an axial displacement by measuring rollers of a measuring tool.

This type of recording can be seen from FIG. 4. As they penetrate into the recesses 4 of the crankshaft 1, the measuring rollers 38 of a measuring tool 57 at the same time undergo a spreading in the axial direction 28. As for a deep-rolling tool 6, the two measuring rollers 38 of the measuring tool 57 are led laterally in cages 33 (FIG. 5). In order to determine the axial displacement of the measuring rollers 38 of the measuring tool 57, there are provided sensors 29 which, for example, determine the size of a spacing 30 between the measuring rollers 38 and the oil collars 31 of a crankshaft 1. The axial position of the measuring rollers 38 before the deep rolling operation makes it possible to identify errors in the pre-processing of the crankshaft 1, i.e., recesses 4 recessed to different depths. The displacement of the measuring rollers 38 during deep rolling makes it possible to identify different rolling depths, e.g. as a consequence of different hardenings in the vicinity of the recesses 4 and thus serves to monitor the process. There is an arrangement corresponding to FIG. 4 where the conditions for attaching sensors 29 to the tool housing 40 of a measuring tool 57 are particularly favorable. In addition, a force sensor 32 can also complete the measuring device 57 which, if necessary, also acts together with a path sensor (not shown) by means of which the path 34 covered by the recess 4 during a revolution of the crankshaft 1 is recorded. The force sensor 32 is, for example, connected via a control line 55 to the supply line 56 via which the pressure medium is supplied to the pressure-medium cylinder 25. The respective magnitude of the deep rolling force is determined and monitored via this possible method of recording the working pressure also familiar to the relevant technical specialist.

Figure 6:
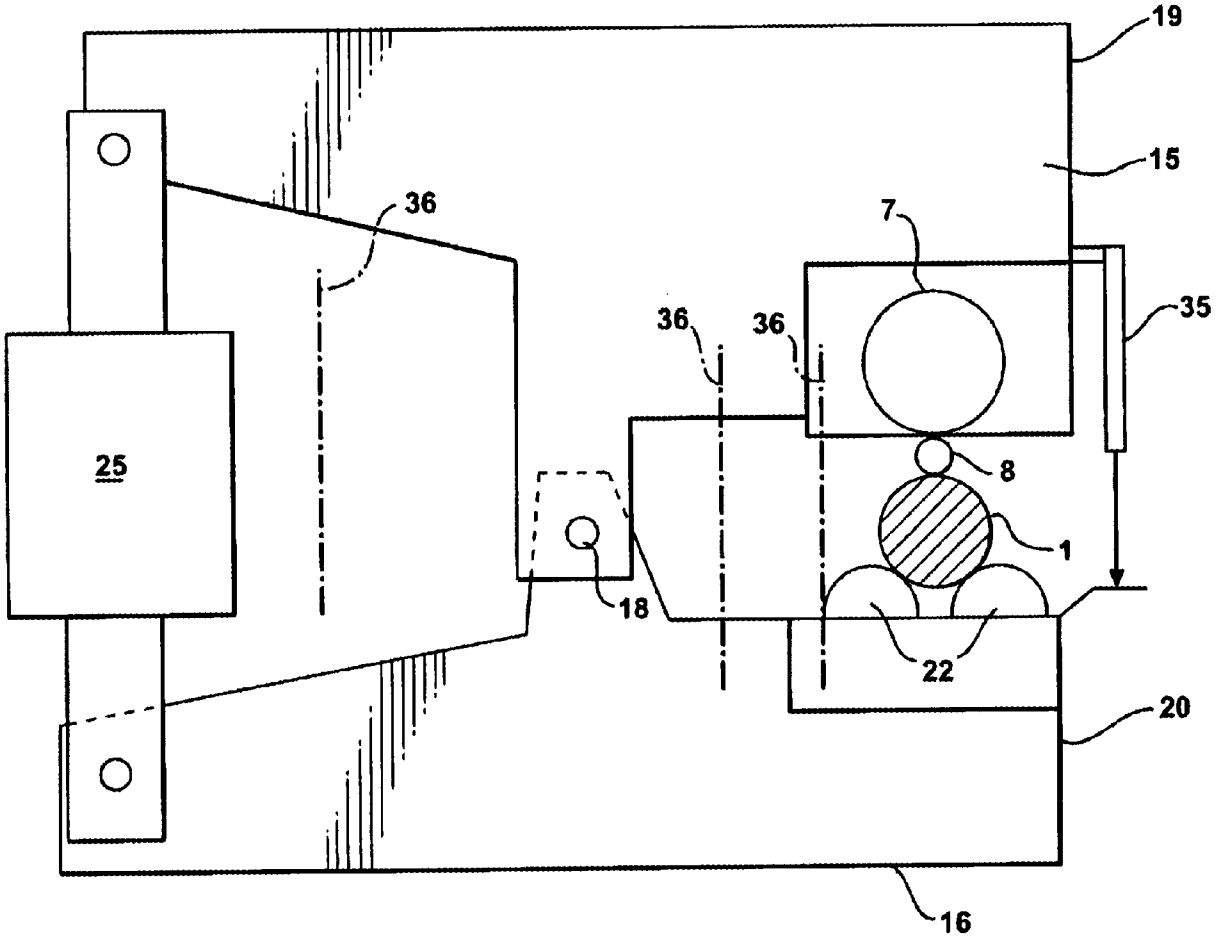
FIG. 6 shows different measuring planes along an equipment arm.

FIG. 6 shows a sensor 35 similar to the sensor 14 which records the radial change in distance between the two first outer ends 19 and 21 of the two equipment arms 15 and 16. In addition to the arrangement at the outer ends 19 and 20, sensors comparable to the sensor 35 can also be attached in the measuring planes 36. Here also the suitable choice of measuring planes 36 is left to the relevant technical specialist. For the particular arrangement it is merely desireable that the measured quantity being sought has tenfold resolution.

Figure 10:
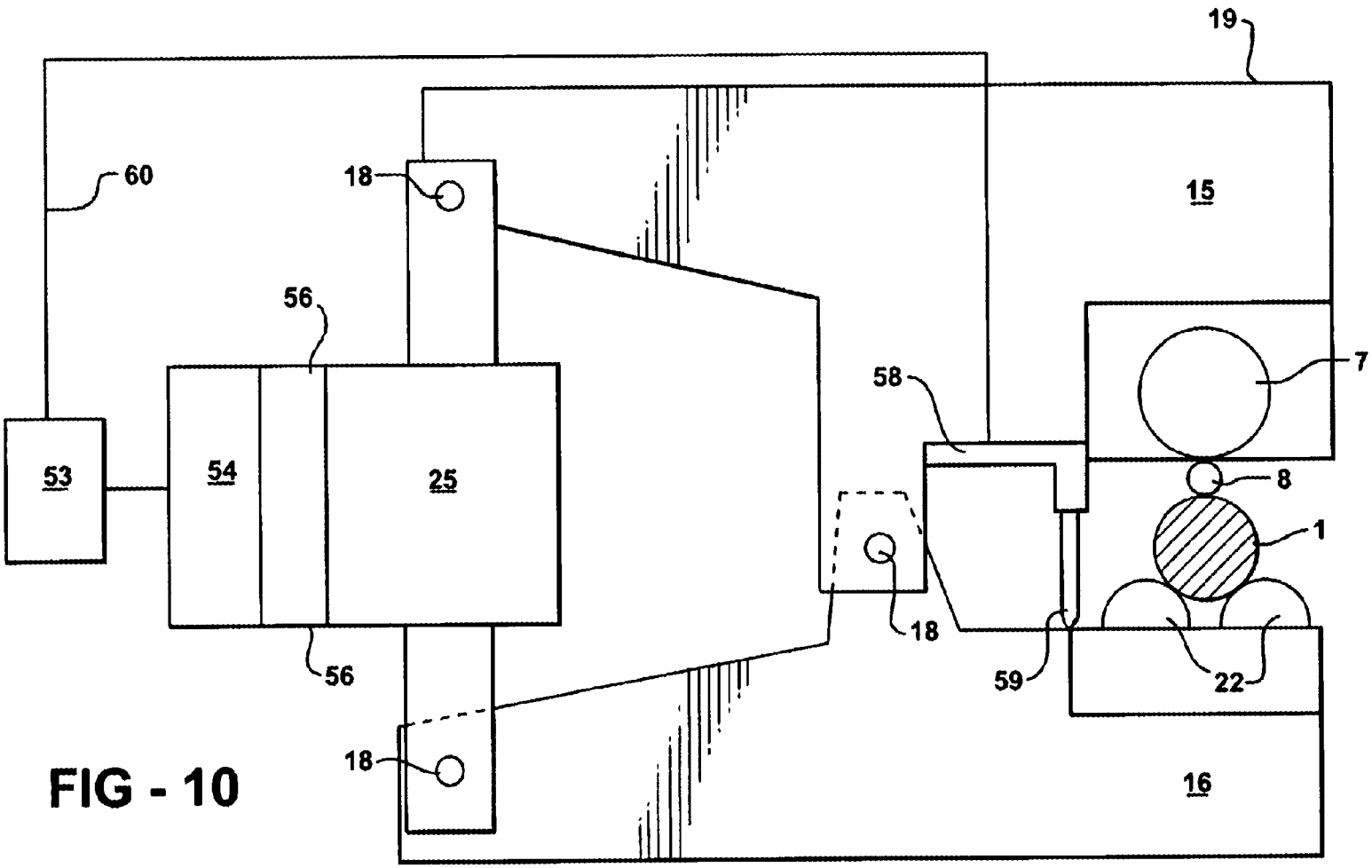
FIG. 10 is a deep-rolling device with a displacement pickup.

An enlarged view substantially corresponding to FIG. 6 is reproduced in FIG. 10. Here a holder 58 is attached between the outer end 20 and the pivot point 18 on the inside of the equipment arm 15. From the holder 58 projects a measuring sensor 59, for example, an inductive displacement pickup, directed towards the equipment arm 16. The measuring sensor 59 can record the distance between the two equipment arms 15 and 16 with high accuracy and is thus suitable for recording the depth of penetration of the deep-rolling roller 8 into the crankshaft 1 without any gaps. The measuring signal passes via a measurement line 60 to the computer 53 which commands the regulator 54 which for its part loads the pressure-medium cylinder 25 via the supply lines 56. The measuring sensor 59 records the penetration depth of the deep-rolling roller 8 with an accuracy of ±0.01 mm in the measurement range.

Figure 7:
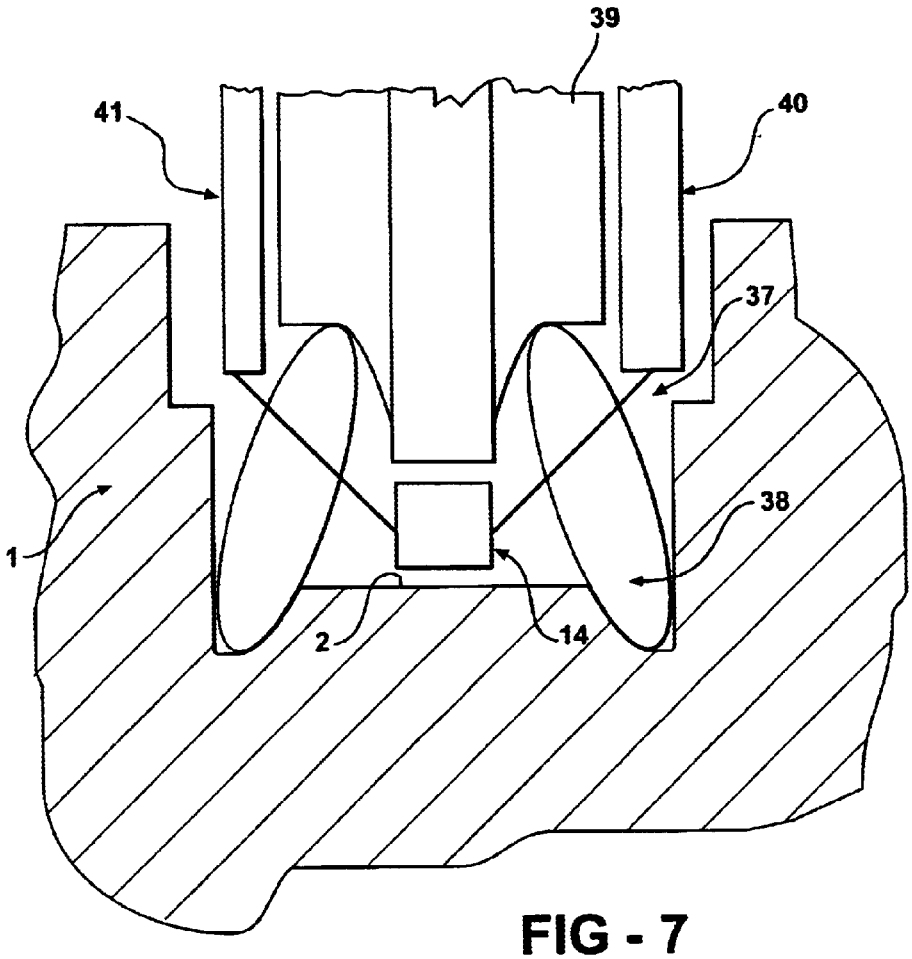
FIG. 7 is a schematic diagram showing the attachment of sensors.
Figure 8:
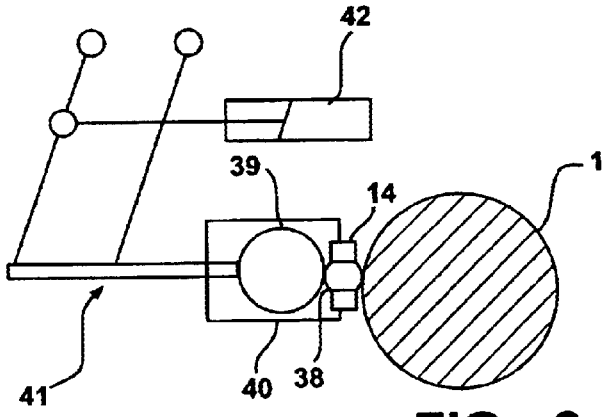
FIG. 8 is a swivellable measuring apparatus.

FIG. 7 shows the schematic attachment 37 of a sensor 14 to a tool housing 40. Instead of the deep-rolling rollers 8, in the representation shown in FIG. 7 there are provided measuring rollers 38 whose size and configuration is comparable to the deep-rolling rollers 8 in FIG. 1. The measuring rollers 38 are also supported by a guide roller 39 inside a tool housing 40. FIG. 7 shows a swivellable measuring device 41. Another representation of such a swivellable measuring device 41 is also shown in FIG. 8. The swiveling of the measuring device 41 is accomplished, for example, via a small pressure-medium cylinder 42. The two devices 41 shown in FIGS. 7 and 8 are purely measuring devices. These are swiveled into the appropriate journal bearing 2 of a crankshaft 1 as soon as the deep-rolling tools 6 to 8 have been brought out of engagement and are then used to monitor the deep-rolling process. If the equipment 42 is suitably configured and attached, e.g. on the equipment arm 15, the depth of penetration 26 of the deep-rolling rollers 8 can also be measured during the deep rolling and the deep rolling force produced via the pressure-medium cylinder 25 can also be regulated as with the sensor 14 integrated in the deep-rolling tool 6.

Figure 9:
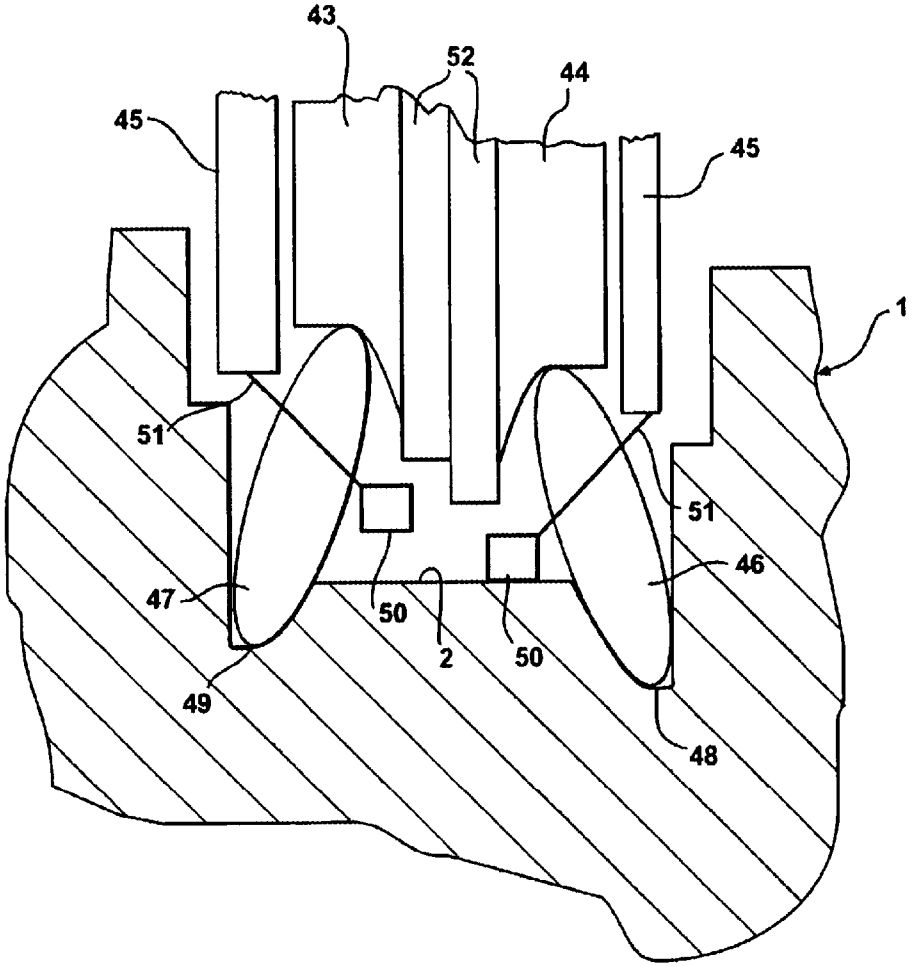
FIG. 9 is an apparatus for measuring different rolling depths.

Another different measuring device is shown in FIG. 9. Here the measuring apparatus consists of two guide rollers 43 and 44 divided in half axially. These two half-rollers 43 and 44 are each rotatably supported in a housing 45. On these are supported measuring rollers 46 and 47 which each penetrate into recesses 48 and 49 of a crankshaft 1. As can be seen from FIG. 9, the recesses 48 and 49 are of different depth, corresponding to different rolling depths. Sensors 50 are again connected to the housing 45 via attachments 51 similar to the attachments 37 in FIG. 7. The device as shown in FIG. 9 is also swivellable and is used for simultaneous measurement of the different rolling depths 48 and 49. Here it is envisaged that the two halves 43 and 44 of a guide roller 52 can move in the radial direction relative to the crankshaft 1. To each of the axes of rotation assigned to the guide rollers 43 and 44 is connected a sensor 50, for example, an eddy current sensor, which determines the displacement of the system relative to the journal bearing 2.

What is claimed is:

1. Apparatus for deep rolling recesses and radii which delimit the journal bearings of crankshafts in the axial direction respectively on both sides, the apparatus comprising:

at least one deep-rolling tool of a deep-rolling machine having a plurality of deep-rolling tools for the recesses and radii on both sides of the journal bearings of crankshafts, wherein the deep-rolling tool is provided at mutually opposing, first outer ends of two scissors-like equipment arms hinge-connected approximately at their longitudinal center;

the at least one deep-rolling tool having a tool housing, in which a guide roller and at least one deep-rolling roller are rotatably supported and the guide roller has a radial spacing from the journal bearing of the crankshaft;

a pressure-medium cylinder between two second outer ends of the equipment arms producing the deep-rolling force;

a sensor for sensing the depth of penetration of the deep rolling roller in recesses and radii of the crankshaft;

a computer connected to the sensor storing the measured values and converting them into operands; and a plurality of control elements connected to the computer with one of the control elements controlling the revolution of the crankshaft and another of the control elements controlling the loading of the pressure-medium cylinder to produce the deep-rolling force as a function of the revolution of the crankshaft and the operands evaluated by the computer.

2. Apparatus according to claim 1, wherein at least one sensor is located between the two first outer ends of the equipment arms to determine the depth of penetration of the deep-rolling roller(s) in the recesses and radii of the crankshaft.

3. Apparatus according to claim 2, wherein the sensor is provided in a first measuring plane along the equipment arms.

4. Apparatus according to claim 1, wherein the sensor is one of an inductive sensor, a triangulation sensor which functions optically, a digital path measuring sensor, a potentiometer, and an ultrasound sensor.

5. Apparatus according to claim 4, wherein the triangulation sensor is constructed using a laser device.

6. Apparatus according to claim 4, wherein at least one of the digital path measuring sensor and the potentiometer are constructed as capacitative devices using eddy currents.

7. Apparatus according to claim 1, wherein the sensor has at least a tenfold resolution with a measuring range of approximately 1 mm, wherein the measured value of the rolling depth lies between 0.1 and 0.9 mm.

8. Apparatus according to claim 1, wherein the sensor is radially located between the guide roller and the journal bearing to determine the depth of penetration of the deep-rolling roller in the recesses and radii of the crankshaft by sensing the distance from the sensor to the journal.

9. Apparatus according to claim 1, wherein the sensor is located between the tool housing and a measuring roller supported by the at least one deep-rolling tool to determine the displacement of the measuring roller in the axial direction of the crankshaft relative to an oil collar on die crankshaft.

10. The apparatus of claim 1 wherein the sensor determines the depth of penetration of the deep-rolling roller in the recesses and radii of the crankshaft by sensing a relative distance between the deep-rolling tool and to the journal.

11. Apparatus for deep rolling a recess and radius which at least partially delimits a journal bearing of a crankshaft comprising;

a deep-rolling tool supported by a machine arm, the deep-rolling tool including a tool housing rotatably supporting a guide roller radially spaced from the journal bearing and engaging the guide roller and the deep rolling recess and radius of the crankshaft;

a hydraulic cylinder manipulating the machine arm to produce a deep-rolling force;

a sensor sensing a depth of penetration of the deep-rolling roller in the recess and radius of the crankshaft;

a computer connected to the sensor storing measured values sensed by the sensor and converting the values into operands; and a plurality of control elements connected to the computer with one of the control elements controlling the revolution of the crankshaft and another of the control elements controlling the loading of the hydraulic cylinder to produce a desired deep-rolling force as function of the revolution of the crankshaft and the operands converted by the computer.

12. Apparatus according to claim 11, wherein the sensor is radially located between the guide roller and the journal bearing to determine the depth of penetration of the deep-rolling roller in the recesses and radii of the crankshaft by sensing the distance from the sensor to the journal.

13. Apparatus according to claim 11, wherein the sensor is located between the tool housing and a measuring roller supported by the at least one deep-rolling tool to determine the displacement of the measuring roller in the axial direction of the crankshaft relative to an oil collar on the crankshaft.

14. Apparatus according to claim 13, wherein the displacement of the measuring roller corresponds to a pre-processing error.

15. A method for deep-rolling a recess and radius which at least partially delimits the journal bearing of a crankshaft including the steps of:

a) sensing a depth of penetration of a deep-rolling roller in a recess and radius of the crankshaft; and b) producing a deep-rolling force based upon said step a).

16. The method of claim 15 wherein said steps a) and b) are repeated a plurality of iterations while exerting a deep-rolling force on the deep-rolling roller.

17. Apparatus for deep rolling recesses and radii which at least partially delimit a journal bearing crankshafts the axial direction, the apparatus comprising:

at least one deep-rolling tool for wiling the recesses and radii of journal bearings of crankshafts, the at least one deep-rolling tool having a tool housing in which a guide roller and at least one deep-rolling roller are rotatably supported, the guide roller having a radial spacing from the journal bearing of the crankshaft;

a sensor for sensing the depth of penetration of the deep rolling roller in recesses and radii of the crankshafts; and a computer connected to the sensor and controlling a loading of the at least one deep-rolling tool based upon the depth values sensed by the sensor.

* * * * *

UNITED STATES PATENT AND TRADEMARK OFFICE

CERTIFICATE OF CORRECTION

PATENT NO. : 6,666,061 B2
DATED : December 23, 2003
INVENTOR(S) : Heimann

It is certified that error appears in the above-identified patent and that said Letters Patent is hereby corrected as shown below:

Column 8,
Line 44, please insert -- in -- before “the” and after “crankshafts”
Line 46, “wiling” should read as -- rolling --

Signed and Sealed this

Sixteenth Day of March, 2004

JON W. DUDAS
*Acting Director of the United States Patent and Trademark Office*